US005283992A

United States Patent [19]

Morassutti

[11] Patent Number: 5,283,992

[45] Date of Patent: Feb. 8, 1994

[54] ADAPTER ELEMENT FOR ANCHORING DEVICES FOR WALL COVERING SLABS

[75] Inventor: Paolo Morassutti, Padua, Italy

[73] Assignee: Fischer Italia Sas di Paolo Morassutti & C., Padua, Italy

[21] Appl. No.: 934,434

[22] PCT Filed: Jan. 15, 1992

[86] PCT No.: PCT/EP92/00073

§ 371 Date: Sep. 14, 1992

§ 102(e) Date: Sep. 14, 1992

[87] PCT Pub. No.: WO92/13153

PCT Pub. Date: Aug. 6, 1992

[30] Foreign Application Priority Data

Jan. 18, 1991 [IT] Italy ..... PD91 U 000005

[51] Int. Cl.[5] ..... E04B 1/38

[52] U.S. Cl. ..... 52/509; 52/397; 52/704; 403/292

[58] Field of Search ..... 52/378, 396, 397, 704, 52/714, 509, 134, 235, 512, 513; 403/292, 294, 298

[56] References Cited

U.S. PATENT DOCUMENTS

| | | | |
|---|---|---|---|
| 581,940 | 5/1897 | Pelton | 52/509 |
| 777,334 | 12/1904 | Dieterich | 52/509 X |
| 2,853,870 | 9/1958 | Sinner et al. | 52/509 X |
| 2,860,504 | 11/1958 | Sinner et al. | 52/509 X |
| 3,342,005 | 9/1967 | Rickards et al. | 52/509 X |
| 3,350,830 | 11/1967 | Smith, Jr. et al. | 52/509 |
| 3,478,480 | 11/1969 | Swenson | 52/396 |
| 3,786,605 | 1/1974 | Winfrey | 52/378 X |
| 4,021,989 | 5/1977 | Hala | 52/378 |
| 4,403,767 | 9/1983 | Basey | 403/292 X |
| 4,422,275 | 12/1983 | Baette | 52/509 |
| 4,523,413 | 6/1985 | Koppenberg | 52/134 X |
| 4,739,602 | 4/1988 | Fricker | 52/704 X |
| 4,783,941 | 11/1988 | Loper et al. | 52/509 X |
| 5,138,809 | 8/1992 | Saikachi | 52/235 |

FOREIGN PATENT DOCUMENTS

| | | | |
|---|---|---|---|
| 841261 | 5/1970 | Canada | 403/298 |
| 2155072 | 9/1985 | United Kingdom . | |

*Primary Examiner*—Peter M. Cuomo
*Assistant Examiner*—Suzanne L. Dino
*Attorney, Agent, or Firm*—Guido Modiano; Albert Josif

[57] ABSTRACT

The adapter element for anchoring devices of the dowel type for wall covering slabs having slotted seats includes a flattened parallelepipedal body which is insertable edgeways in the slotted seat of a slab and a laminar wing which extends laterally from the base of the body. A hole for the insertion of the dowel of the anchoring device is arranged in a median region in the body.

5 Claims, 1 Drawing Sheet

ADAPTER ELEMENT FOR ANCHORING DEVICES FOR WALL COVERING SLABS

BACKGROUND OF THE INVENTION

The present invention relates to an adapter element for anchoring devices for wall covering slabs.

It is currently common to cover walls with slabs, generally made of marble, which are associated with said walls by means of various types of brackets which are fixed by means of screw anchors.

One type of anchoring comprises a pivot which is associated with a wall fixing bracket, is arranged horizontally and has a flattened end to be arranged parallel to the floor.

Said flattened end is crossed by a hole in which a dowel is inserted; said dowel is arranged vertically, and its ends are suitable for being inserted in respective seats provided in the edge of the slabs.

Said seats can be constituted by both holes and slots.

Whereas in the case of holes the dowels adapt without trouble to the seats and coupling is stable, in the case of slots the slabs, after anchoring, still have a certain degree of freedom and the coupling is not particularly stable.

SUMMARY OF THE INVENTION

The aim of the present invention is therefore to provide an adapter element to be used for anchoring devices of the dowel type if the slabs have slotted seats.

A consequent primary object is to provide an adapter element which allows an optimum engagement of the slabs.

Another important object is to provide an adapter element which is easy to manufacture and has a low cost.

Not least object is to provide an adapter element which is easy to install.

This aim, these objects and others which will become apparent hereinafter are achieved by an adapter element for anchoring devices of the dowel type for wall covering slabs having slotted seats, characterized in that it comprises a parallelepipedal flattened body insertable edgeways in the slotted seat of a slab and a laminar wing which extends laterally from the base of said body, a hole for the insertion of the dowel of the anchoring device being arranged in a median region of said body.

BRIEF DESCRIPTION OF THE DRAWINGS

Further characteristics and advantages of the invention will become apparent from the detailed description of an embodiment thereof, illustrated only by way of nonlimitative example in the accompanying drawings, wherein.

DESCRIPTION OF THE PREFERRED EMBODIMENTS

Figure 1:
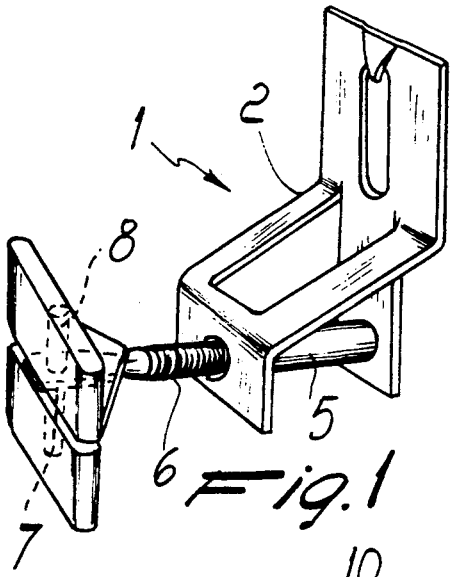
FIG. 1 is a perspective view of a slab anchoring device provided with adapter elements according to the invention.
Figure 2:
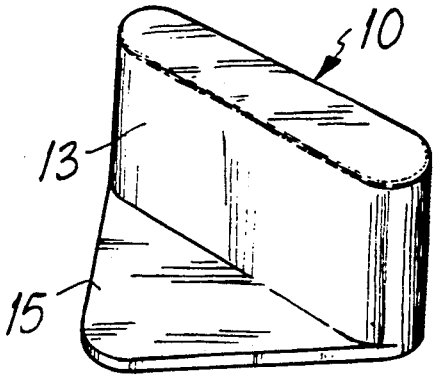
FIG. 2 is a perspective view of the adapter element according to the invention.
Figure 3:
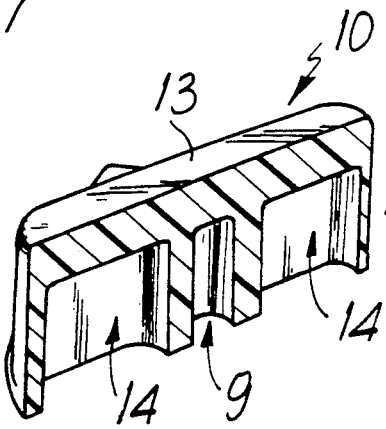
FIG. 3 is a perspective longitudinal sectional view of the element of FIG. 2.
Figure 4:
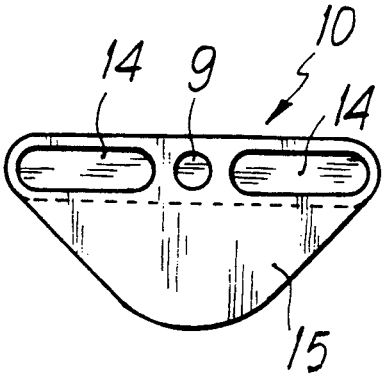
FIG. 4 is a bottom view of the element of FIG. 2.

With reference to the above figures, a conventional slab anchoring device is generally designated by the reference numeral 1 and comprises a bracket 2 which is fixed to the wall 3 by means of a screw anchor 4.

Said bracket 2 supports a horizontally arranged tubular element 5 inside which a complementarily threaded pivot 6 is screwed; said pivot protrudes from said tubular element with a flattened end 7 which is arranged conveniently parallel to the floor.

Said end 7 is crossed by a hole in which a vertically arranged dowel 8 is inserted.

Both ends of the dowel 8 are in turn inserted in corresponding blind holes 9, each of which is located in the median region of a respective adapter element 10 to be arranged in the corresponding slotted seat which is located in the edge of a related covering slab 12.

According to the invention, each adapter element 10 comprises a flattened parallelepipedal body 13 which has such a thickness as to be inserted edgeways snugly inside said slot 11.

Said element 10 is conveniently made of plastic material, and its body 13 is provided with rounded ends and, laterally to the central hole 9, with slots 14 whose presence has the only purpose of limiting the thicknesses of the plastic material.

Still according to the invention, a laminar wing 15 extends laterally from the base of said body 13; the profile of said wing is substantially a right-angled triangle in which the vertex which corresponds to the right angle is rounded and arranged along the centerline of said body 13, and said wing is suitable for being arranged between the flattened end 7 and the head of the corresponding slab 12, constituting a sort of spacer for the exact placement of said slab.

Figure 5:
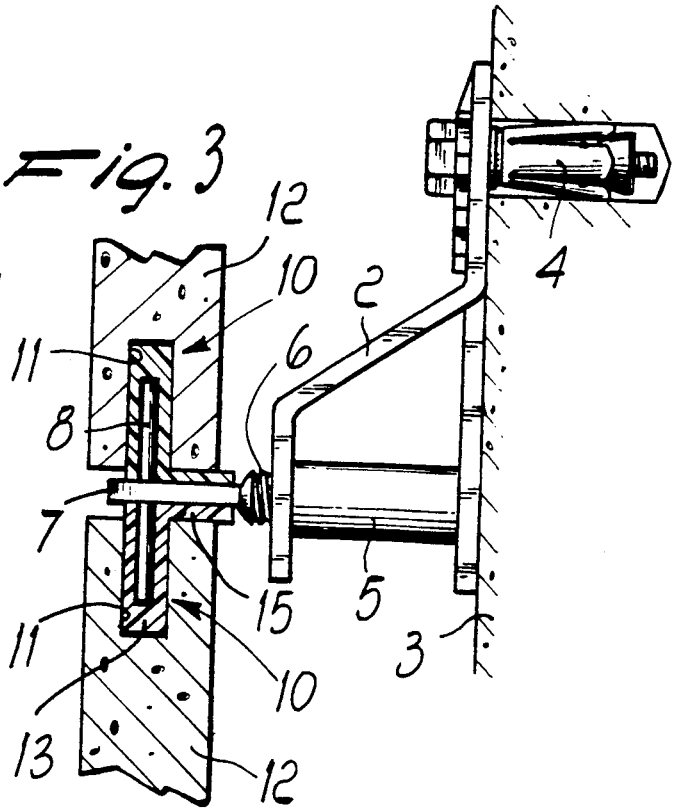
FIG. 5 is a view of the fitting of an anchoring device with adapter elements according to the invention.

As seen in FIG. 5, a pair of adapter elements are provided one above and the other below the flattened end 7 of the pivot 6

In this manner it is possible to provide, easily and without problems, a perfect alignment of the slabs, providing constant-width gaps between them.

It should also be stressed that the adapter element according to the invention acts on a wider slab region with respect to the simple dowel and thus avoids concentrations of tensions due to the reaction of the restraint constituted by the anchoring device which might easily lead to breakages of the walls which delimit the seat.

In practice it has thus been observed that the adapter element according to the invention has achieved the intended aim and objects.

In practice, the materials employed, so long as compatible with the contingent use, as well as the dimensions, may be any according to the requirements.

I claim:

1. Adapter element for dowel-type anchoring devices for wall covering slabs having slotted seats, said adapter element comprising a parallelepipedal flattened body insertable edgeways in a slotted seat of a slab and having a base, a laminar wing extending laterally from said base of said body, a hole for insertion of a dowel of an anchoring device being arranged in a medium region of said body, wherein said dowel insertion hole is a blind hole.

2. In combination, a slab anchoring device fixable to a wall and an adapter element, said slab anchoring device comprising;

a bracket;

a tubular element supported by said bracket;

a threaded pivot threadedly engaging said tubular element;

an end defined by said threaded pivot and protruding from said tubular element;

a hole formed in said end of said threaded pivot;

a dowel inserted in said hole and having ends; said adapter element comprising;

a parallelepipedal flattened body insertable edgeways in a slotted seat of a slab and having a base;

a central hole formed in a median region of said body and accommodating one of said ends of said dowel;

a plurality of slots formed in said body laterally of said central hole, and a laminar wing extending laterally from said base of said body and locatable between adjacent slabs.

3. Combination according to claim 2, wherein said adapter element is made of plastic material.

4. Combination according to claim 2, wherein said central hole is a blind hole.

5. Combination according to claim 2, wherein said laminar wing has a triangular configuration.

* * * * *